United States Patent [19]

Ruyer

[11] 4,250,850

[45] Feb. 17, 1981

[54] REDUCED LOAD WORKING CYCLE FOR A FOUR-STROKE COMBUSTION ENGINE AND ENGINES USING SAID CYCLE

[76] Inventor: Charles Ruyer, 24 rue Foch, 57390 Audin le Tiche, France

[21] Appl. No.: 971,685

[22] Filed: Dec. 21, 1978

[30] Foreign Application Priority Data

Dec. 29, 1977 [FR] France ..... 77 39560

[51] Int. Cl.[3] ..... F02B 75/00; F02G 3/02

[52] U.S. Cl. ..... 123/198 F; 123/59 EC; 60/600; 60/620; 60/622

[58] Field of Search ..... 123/59EC, 198 F; 60/600, 620, 622

[56] References Cited

U.S. PATENT DOCUMENTS

| | | | |
|---|---|---|---|
| B 282,390 | 1/1975 | Siewert | 123/59 EC |
| 2,280,487 | 4/1942 | Heylandt | 60/622 |
| 3,085,392 | 4/1963 | Sampietro | 60/600 |
| 3,183,661 | 5/1965 | Peterson | 60/600 |
| 3,270,724 | 9/1966 | Dolza | 60/600 |
| 3,808,818 | 5/1974 | Cataldo | 123/59 EC |
| 4,075,980 | 2/1978 | Anger | 60/620 |
| 4,159,699 | 7/1979 | McCrum | 60/620 |

FOREIGN PATENT DOCUMENTS 2740045 3/1979 Fed. Rep. of Germany ..... 123/59 EC

OTHER PUBLICATIONS

"Dual-Mode Engine Recycles Exhaust Gas" Automotive Engineering, Mar. 1979, pp. 100–101.

*Primary Examiner*—P. S. Lall

*Attorney, Agent, or Firm*—Fisher, Christen & Sabol

[57] ABSTRACT

The invention relates to piston-type internal combustion engines.

A four-stroke engine in which, on reduced load, a part of the cylinders is used as combustion cylinders, the other part forming an additional expansion enclosure for the gases issuing from the combustion cylinders before their expulsion into the atmosphere. The engine operates on full load according to the conventional cycle.

Application to the improvement of the output for motor vehicle engines when they operate on medium or low load.

6 Claims, 22 Drawing Figures

Figure 4B:
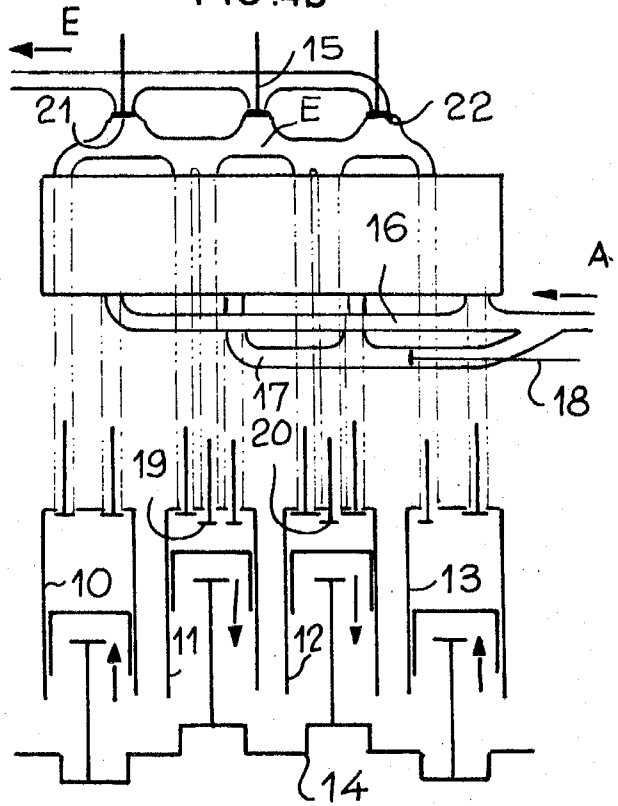

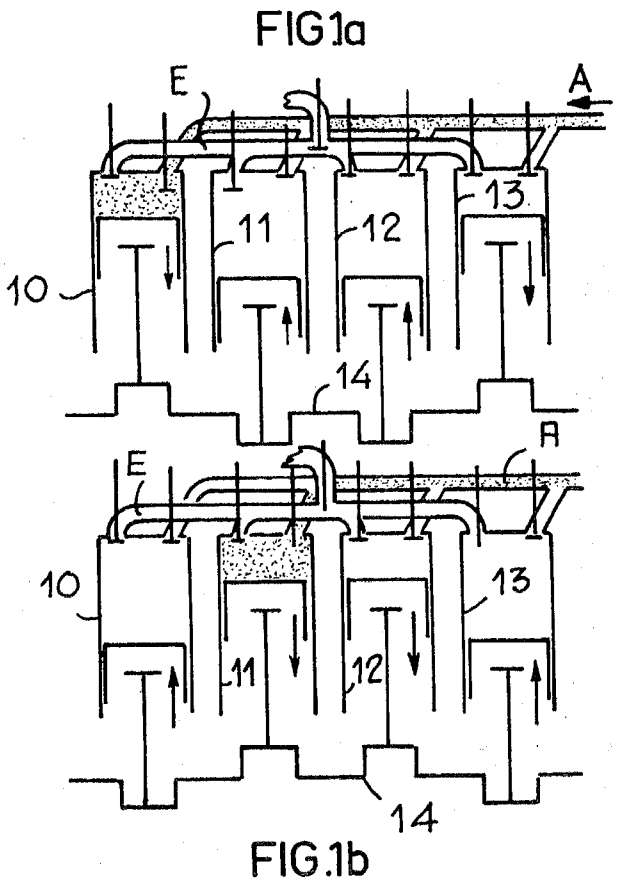
FIG.1a
FIG.1b
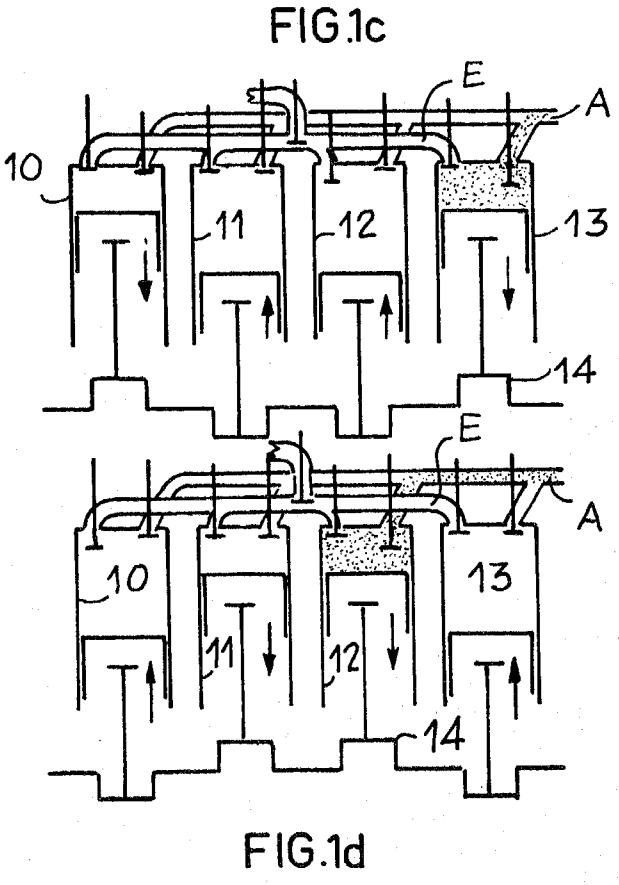
FIG.1c
FIG.1d

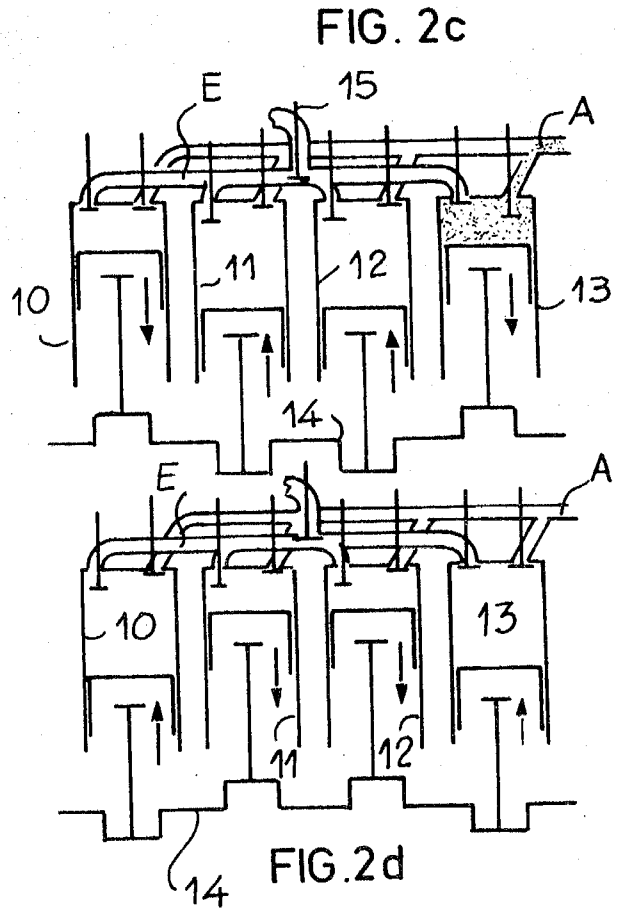
FIG. 2c
FIG. 2d
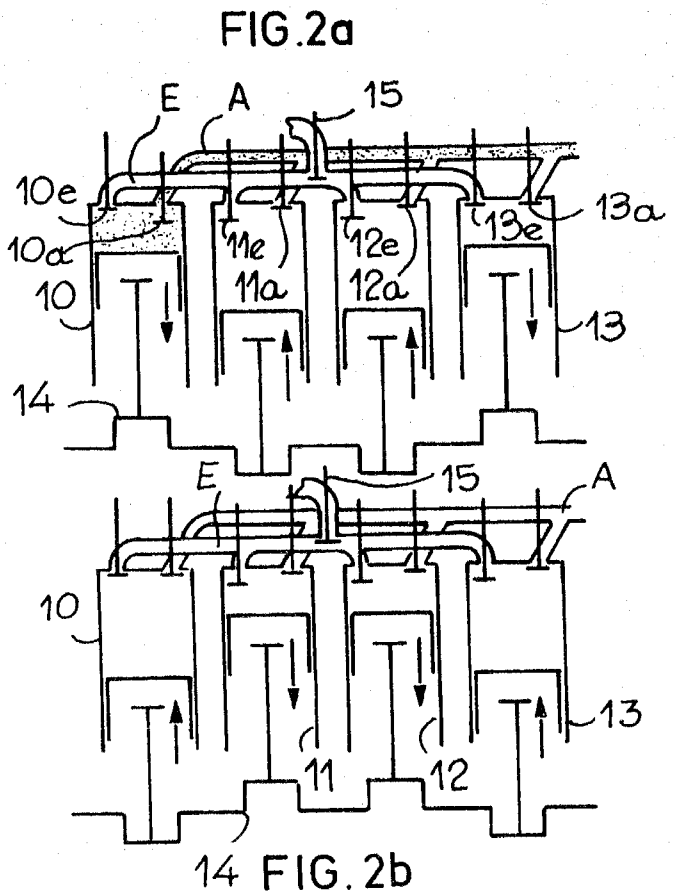
FIG. 2a
FIG. 2b

REDUCED LOAD WORKING CYCLE FOR A FOUR-STROKE COMBUSTION ENGINE AND ENGINES USING SAID CYCLE

The present invention relates to four-stroke internal combustion engines used for the propulsion of motor vehicles; in such a use, the engine operates on full load only seldom, and generally on motorways where prolonged operation at high speed is possible; on the other hand, on most roads, major or secondary, and for traffic through inhabited areas, the engine rate is almost always on medium or low load.

Reduced load running makes it possible to have a reserve of power available, which facilitates for the driver the operation of the vehicle; as the output of such an engine decreases substantially when the load, that is to say the filling of the engine, decreases, the engine is thus used in most cases according to the conventional cycle in a field in which it operates with poor output.

The aim of the present invention is substantially to increase the yield of such engines in the range of use of low and medium loads, without reducing their maximum power, or reducing the quality of their output in the field of high power.

The present invention has for its object an improved reduced load operation cycle for a four-stroke internal combustion engine and with an operating enclosure with several cylinders, characterised in that only a part of the cylinders is used as combustion cylinders, the gases generated by combustion in any one of these cylinders being subjected to an additional expansion in the remainder of the working enclosure before being expelled into the atmosphere, the engine again working according to the conventional cycle when it operates on full load.

In particular in the case of an engine with one or two groups of four cylinders, in each group combustion will advantageously take place in two cylinders staggered by 360° rotation of the crankshaft, the other two cylinders, staggered by ±180° rotation of the crankshaft, being inserted in the additional expansion enclosure.

The invention has also for its object the structural arrangements of the distribution permitting the operation of a four-stroke engine according to the above improved cycle for the reduced loads.

On the economic rating which results from this cycle, and according to a first preferred arrangement of the invention, for the expansion cylinders admission is permanently closed, while the exhaust remains permanently open; a sealing member is placed on the exhaust pipe leading into the atmosphere and this member is closed when the pistons of the expansion cylinders travel downwards, and open as they travel upwards again, the closure being controlled by the position of the crankshaft.

According to a second preferred arrangement, an additional duct conducts the exhaust of the combustion cylinders to the inlet valves of the expansion cylinders, said valves being open with each corresponding lowering of the pistons, and closed on each upward stroke, the exhaust valves of the said cylinders conforming to a reverse procedure.

The invention has furthermore for its object the four-stroke engines using on reduced load the previously defined economic or improved cycle and comprising the relevant structural arrangements of the distribution.

Each of the two arrangements outlined above may be completed by other measures forming part of the invention and which will appear in the course of the following description referring more particularly to the attached drawing showing some non-limitative examples of embodiment of the invention.

On said drawing,

FIGS. 1*a* to 1*d* are a working diagram of a four-cylinder engine, four-stroke type, provided, within the framework of the invention, with a sealing member on the exhaust, but operating according to the conventional cycle on full load.

FIGS. 2*a* to 2*d* correspond respectively to FIGS. 1*a* to 1*d* in the case of operation on improved cycle on reduced load.

Figure 3B:
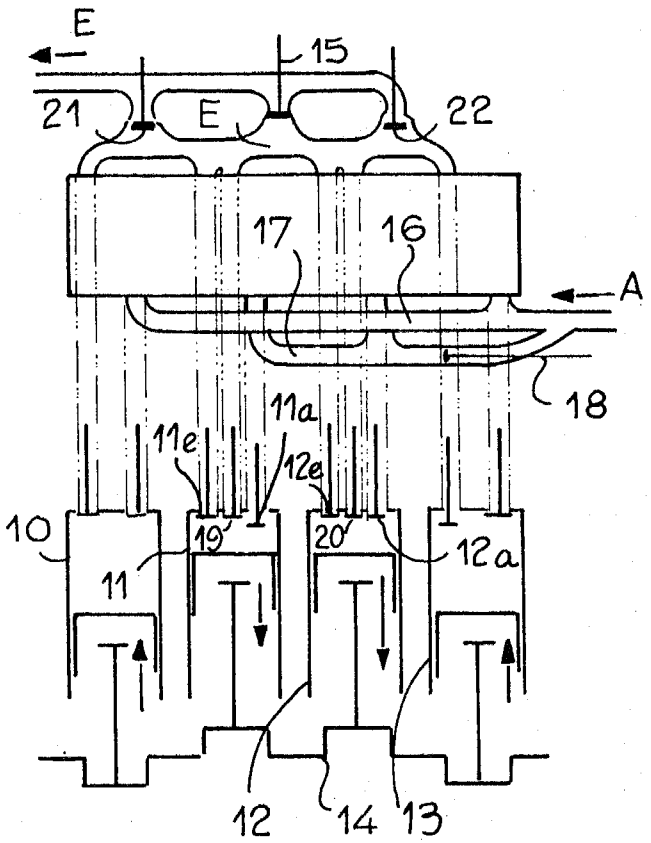

FIGS. 3*b* and 4*b* correspond respectively to FIGS. 1*b* and 2*b* and show, according to a first alternative, the outline of the admission and exhaust ducts as well as the equipment with additional valves of the distribution of the engine to permit passing from the full load conventional cycle to the reduced load improved cycle.

FIGS. 5*c*, 5*d*, 5*a*, 5*b* correspond respectively to FIGS. 2*c*, 2*d*, 2*a*, 2*b* and they show, according to a second alternative with further increased output how, through the addition of an intermediate chamber with permanent communication with the expansion cylinders, it is possible to pass from the conventional full load cycle to the improved reduced load cycle.

FIGS. 6*c*, 6*d*, 6*a*, 6*b* and FIGS. 7*c*, 7*d*, 7*a*, 7*b* show another means permitting passing from the conventional full load cycle (FIG. 6) to the improved reduced load cycle (FIG. 7) without the addition of further valves, but with an additional duct connecting the exhaust of the combustion cylinders to the inlet valves of the expansion cylinders.

The four-stroke engine represented in FIGS. 1 and 2 is a four-cylinder engine 10, 11, 12 and 13 with crankshaft 14; on full load, in the conventional cycle (FIG. 1), the four cylinders are used in succession, and half turn by half turn of the crankshaft, as combustion cylinders; in the improved cycle on reduced load (FIG. 2) according to the invention, the two cylinders 10 and 13 staggered by 360° rotation of the crankshaft are always used as combustion cylinders, while the two cylinders 11 and 12 are used solely as an expansion chamber for the cylinders in which combustion takes place: these two cylinders 11 and 12 are staggered relatively to each other by 360° rotation of the crankshaft of ±180° relative to each combustion cylinder. It will thus be observed that the pistons of these two cylinders 10 and 13 always occupy identical positions, and the same applies to the pistons of the two expansion cylinders.

The gas cycle according to conventional rating (FIG. 1) is known and there is no need to revert to it here; for the improved reduced load cycle there is first of all an admission; see, for example, cylinder 10, FIG. 2*a*, then compression (FIG. 2*b*), firing and expansion (FIG. 2*c*) and expulsion (FIG. 2*d*), the admission 10*a* and exhaust 10*e* valves occupying at each stroke the required positions which are the same as those of the conventional cycle.

But during the expulsion, the gases, instead of being thrown out immediately into the atmosphere, are sent to the two expansion cylinders 11 and 12 (FIG. 2*d*); the gases thus continue their volume expansion, inside the working enclosure, during the downward travel of the pistons of the two expansion cylinders and the renewed upward travel of the piston of the sole combustion cylinder 10 in communication with the said expansion cylinders.

In this expansion phase (FIG. 2) the gases being everywhere at the same pressure produce an engine performance equal to their acton upon the piston of one of the two expansion cylinders, the work produced by the action on the piston of the second expansion cylinder being exactly compensated by the resistance work exerted on the piston of the combustion cylinder 10. Finally, the two expansion cylinders are placed in communication with the atmosphere and the gases are thrown out by the renewed upward travel of the pistons (FIG. 2*a*).

There is thus an improvement of the output during such a cycle, but to achieve this the valves of the two expansion cylinders cannot any longer occupy the same positions as in the conventional cycle and exhaust to the atmosphere must be able to undergo sealing times; this is that which is now going to be set out, again referring to FIG. 1 and especially FIG. 2.

The general intake manifold A must be cut off its connection with the two expansion cylinders, that is to say the two inlet valves 11*a* and 12*a* will be constantly closed on reduced load; this may also be achieved by placing a sealing device of any type closed upstream of each inlet valve, and as near as possible to it to reduce to the minimum the volume comprised between the said sealing device and the valve.

On the other hand, on the general exhaust manifold E the exhaust valves 11*e* and 12*e* remain constantly open on reduced load, and this manifold E constitutes the expansion duct according to the invention. On the direct outlet to the atmosphere provision will then be made for a valve or a seal 15 permitting an intermittent closure controlled by the position of the crankshaft (case of FIGS. 2*b* and 2*d*); this sealing device will be, in accordance to that which has been previously stated, closed during the downward travel of the pistons of the expansion cylinders and open when they go up again.

These arrangements intended to ensure the operation in improved reduced load cycle are in no way opposed to the going over to conventional full load cycle.

For the purpose, in the two expansion cylinders, the valves locked in closed position for admission and in open position for exhaust are released and resume their normal operation; in due course the sealing devices upstream of the inlet valves are placed in open position.

The sealing device 15 of the exhaust is set in permanent open position or short-circuited by a sealing device in parallel; it should be noted that this sealing device (valve or seal) may be of multiple type (according to the engine and its design), and in this case the short-circuiting sealing device will also be of multiple or single type with a multiple sealing device.

This going over from the economic operation method to the normal operation method may appear complicated; it is possible to simplify it by adopting the provisions laid down in FIGS. 3 and 4.

So as not to multiply needlessly the number of figures a representation has been given only of cases 3*b* and 4*b* corresponding to FIGS. 1 and 2 respectively.

In this arrangement the inlet manifold A is divided into two branches 16 and 17, branch 16 being connected to combustion cylinders 10 and 13 and branch 17 to the expansion cylinders 11 and 12; a seal 18 is provided on branch 17. Alternatively, the inlet manifold A could be divided into four separate feeds for the four cylinders; valve 18 would then be replaced by two valves, respectively, one on the inlet of cylinder 11 and one of the inlet of cylinder 12.

The exhaust valves 11*e* and 12*e* of the expansion cylinders are each duplicated by an additional valve 19 and 20, respectively; on normal rating these two valves will always be closed (FIG. 3*b*) and on economic rating they will always be open (FIG. 4*b*); as to the exhaust valve 15 (single or multiple) to the atmosphere, it may be short-circuited by two additional valves 21 and 22 always open in normal operation. This arrangement is not exclusive: thus the two valves 21 and 22 could be replaced by a single valve, or any number of valves different from two, but in general below or equal to four.

Accordingly the going over from one method of operation to the other is effected by a simple action on valve 18 and the additional valves 19, 20 and seals 18, 21 and 22, according to the following table:

| | |
|---|---|
| Normal rating (FIG. 3 b), permanently | seal 18 is open<br>valves 19 and 20 are closed<br>valves 21 and 22 are open |
| Economic rating (FIG. 4b), permanently | seal 18 is close<br>valves 19 and 20 are open<br>valves 21 and 22 are closed |

With such an arrangement, on full load in the normal method of operation, the behaviour of the engine remains practically unchanged relatively to that of the conventional engine. On low and medium load, the output of the conventional engine deteriorates: the arrangements according to the invention then permit obtaining the maximum output on medium load which corresponds to the complete filling of the engine on economic rating.

The output gain under those conditions is of the order of 25 to 30% and it increases slightly towards the low loads, for starting from the medium load rating, the output of an engine in normal method of operation deteriorates a little faster than that of the same engine on economic method of operation, as we proceed towards low loads. As these conditions of use are most frequent for a motor-car engine, the interest of the invention is confirmed.

For certain trips it is advisable to avoid passing too frequently from one method of utilisation to the other; with the arrangements according to the invention, normal operation on low load may be retained.

It is possible within the framework of the invention to improve further the output gain on economic rating:

Indeed, if we look at FIG. 4, we see that at the end of the phase of expansion of the gases into the expansion cylinders, the gases present in the expansion duct E, placing the exhausts of the various cylinders in communication, remain at a pressure higher than atmospheric pressure; accordingly the opening of the sealing member 15 brings about a drop of pressure in the expansion duct to atmospheric pressure, that is to say there is loss of power. This is detrimental to the output, and all the more so as the volume of the expansion duct is more substantial.

This drop to atmospheric pressure may be avoided, as represented in FIGS. 6 on economic rating, by the creation of a lock chamber or intermediate chamber 23 which makes it possible to isolate the expansion duct E from the atmosphere during the phase of exhaust of the gases contained in the expansion cylinders 11 and 12.

In the embodiment according to FIG. 5, the valve or inlet seal 18 of the expansion cylinders and the valves 21 and 22 for short-circuiting of the sealing member 15 are permanently closed, valves 19 and 20 are permanently open, in economic rating (as in the embodiment according to FIG. 4).

Figure 5B:
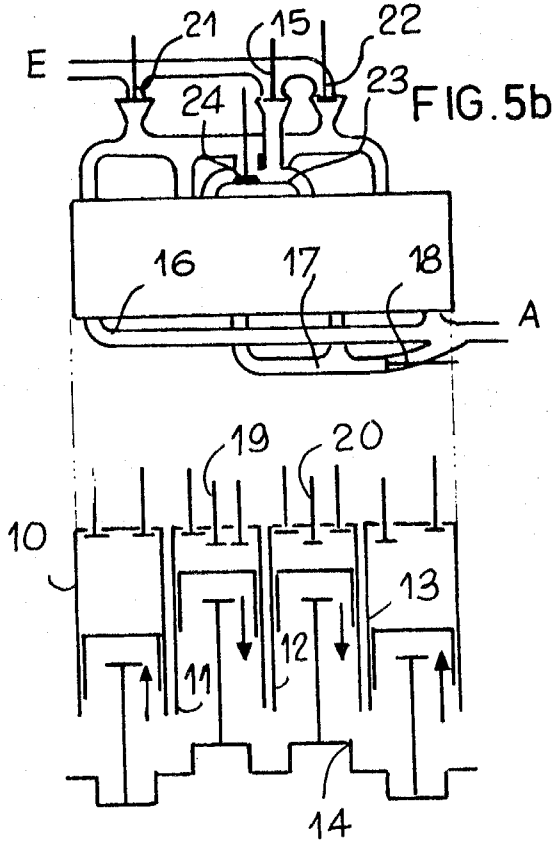
Figure 5A:
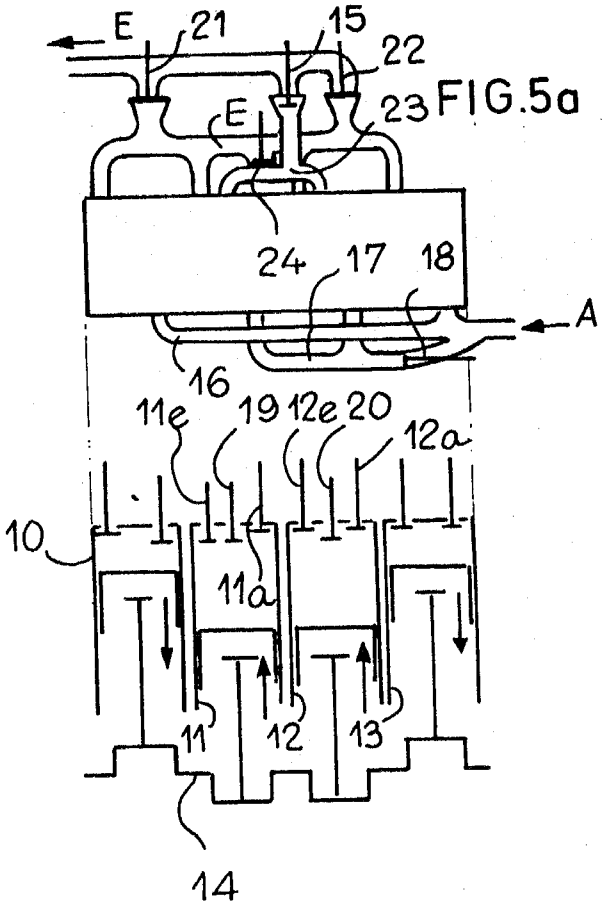

The volume of the intermediate chamber 23 is the space comprised under the seal 15 for exhaust to the atmosphere and the additional valve (single or multiple) 24 of the lock chamber; during the operation of the engine, when one of the valves is closed, the other is open and conversely. The phases of the improved cycle are then the following:

FIG. 5*a:* Exhaust to the atmosphere of the gases contained in the expansion cylinders and the intermediate chamber:

Seal 15 open

Valve 24 closed

The expansion duct E is isolated from the atmosphere by valve 24.

FIG. 5*b:* After explosion, transfer of the gases of combustion cylinder 13 to the expansion cylinders:

Seal 15 closed

Valve 24 open

The transfer to the expansion cylinders is effected by the expansion duct E and the intermediate chamber 23, the whole being isolated from the atmosphere.

Figure 5D:
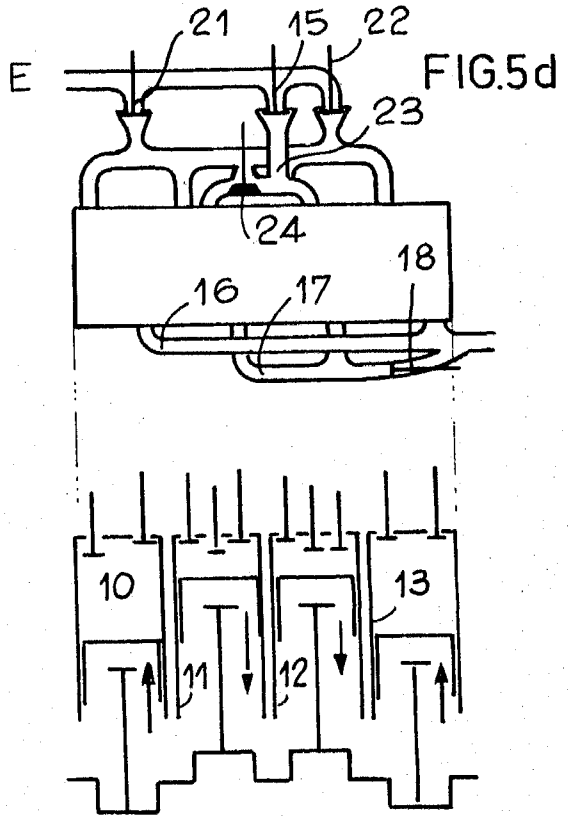
Figure 5C:
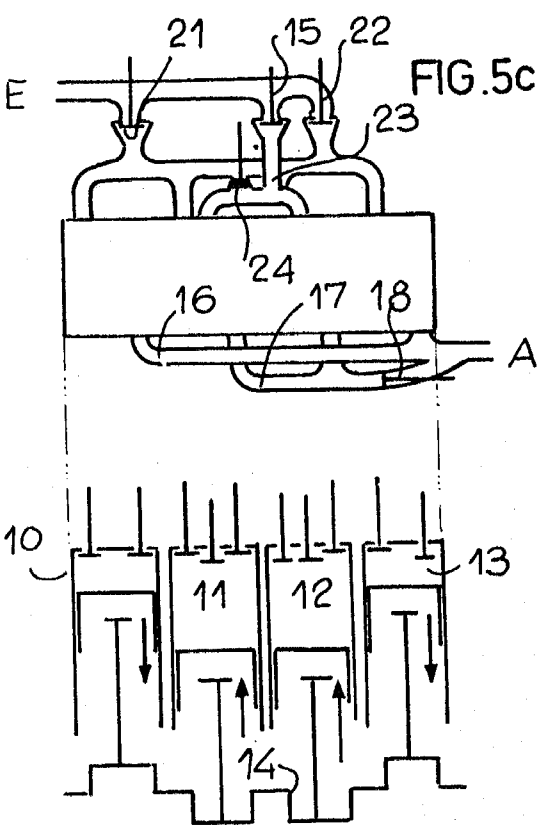
Figure 6B:
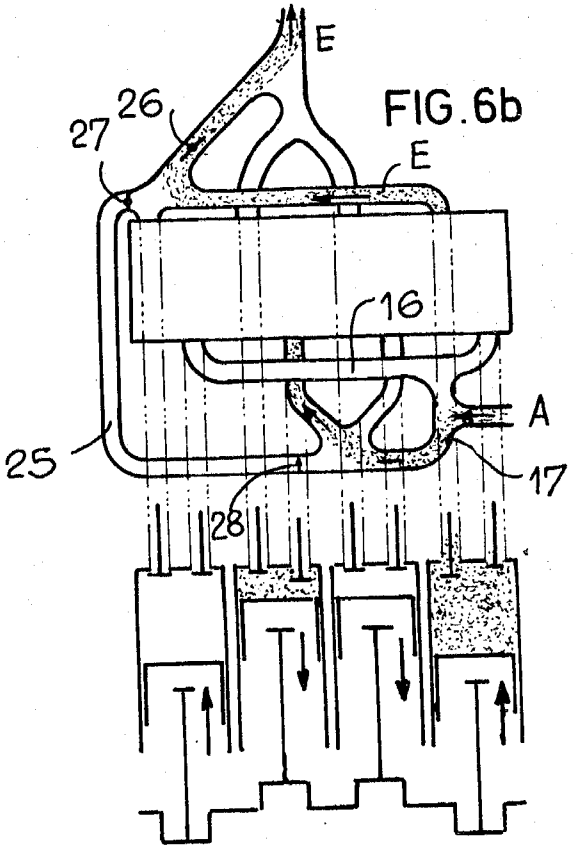
Figure 6A:
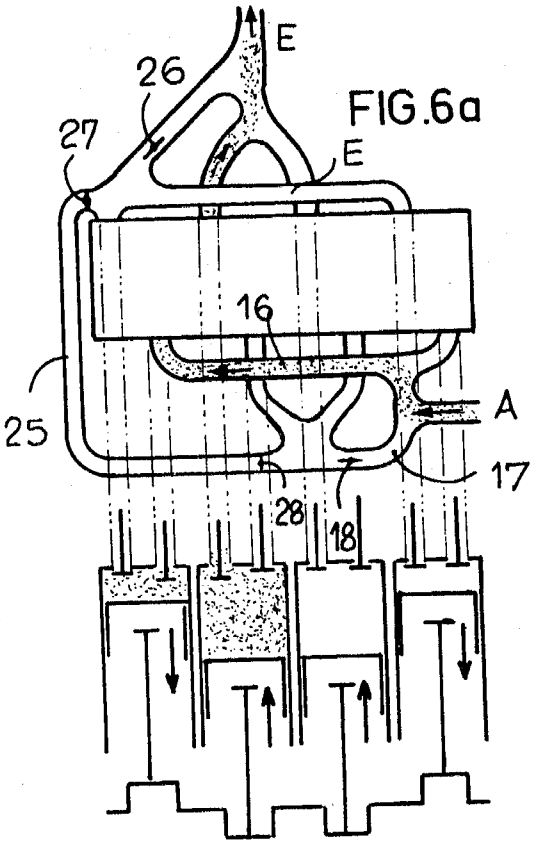
Figure 6D:
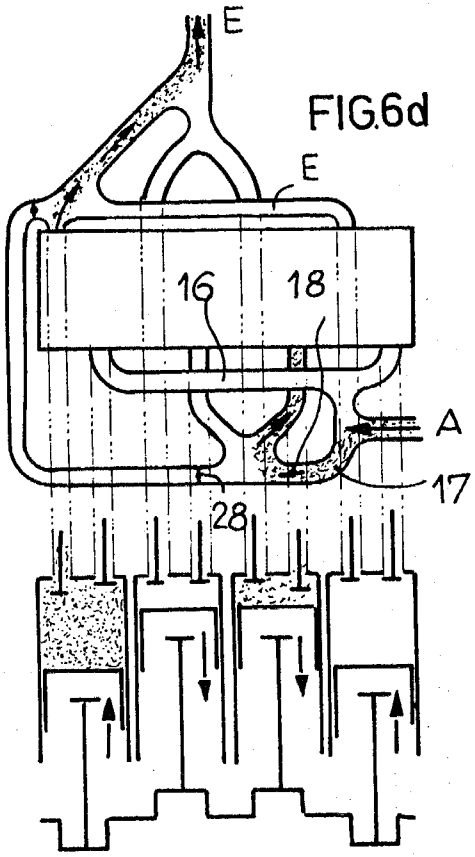
Figure 6C:
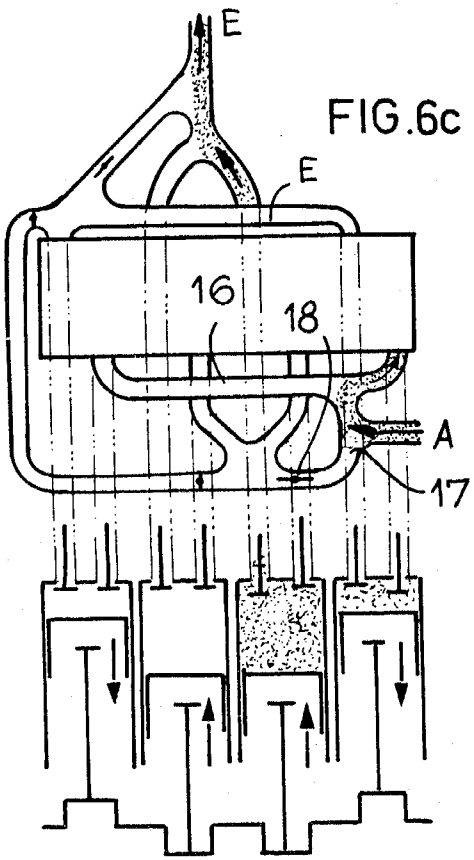

FIG. 5*c:* Exhaust of the gases contained in the expansion cylinders and the intermediate chamber.

Seal 15 open

Valve 24 closed

The expansion duct E is again isolated from the atmosphere.

FIG. 5*d:* After explosion, transfer of the gases of the combustion cylinder 10 to the expansion cylinders:

Seal 15 closed

Valve 24 open

The transfer to the expansion cylinders is effected through the expansion duct and the intermediate chamber, the whole being insulated from the atmosphere.

And the same cycle is repeated as long as the operation lasts.

It should be noted that valves 15 and 24 controlling the intermediate chamber retain an operation independent of the rating, whether economic or normal; valve 24 may be a single one or of multiple type.

These arrangements according to FIG. 5 have the additional advantage of permitting their application to cylinders which are not exactly staggered by 180° in the four-stroke cycle, that is to say for which dephasing between the end of the expansion phase of a combustion cylinder and the start of the downward movement of the pistons of the expansion cylinders is not necessarily nil. This is made possible by the reserve volume which the expansion duct E constitutes, provided the latter has actually an adequate volume.

The invention then applies to any four-stroke engine having any number of cylinders greater than two, and in particular to six-cylinder engines.

In the arrangements according to the invention described so far, the going over to improved reduced load cycle is obtained through the intervention of a sealing device 15 for exhaust to atmosphere and with the utilisation of additional valves, such as 19 and 20, duplicating the exhaust valves of the expansion cylinders. The same cycle may be obtained if these devices are not present, but with the use of the arrangements which are now going to be described with reference to FIG. 6, in normal rating, and FIG. 7, economic rating.

In this embodiment, the intake manifold is divided into two branches 16 and 17 with a sealing device 18 permitting, on economic rating, cutting the intake on the expansion cylinders; in addition an additional manifold 25 connects the exhaust of the combustion cylinders 10 and 13 to the intake of the expansion cylinders with a set of valves or other sealing device 26, 27 and 28 permitting passing over from the economic rating to the normal rating and conversely; valve 26 placed on the side with the exhaust of the combustion cylinders to the atmosphere is open on normal rating and closed on economic rating; valves 27 and 28 placed at each end of the manifold 25 have a position always the reverse of that of valve 26. Finally, the intake valves 11*a* and 12*a* of the expansion cylinders are, on operation on economic rating, coupled on opening as well as on closing, in the same way as the exhaust valves 11*e*, 12*e*, which permits the playing by these valves of the part of additional valves left out 19 and 20.

The operation on normal rating and economic rating is therefore summarised as follows:

| | |
|---|---|
| Normal rating: | Seal 18 open<br>Valve 26 open<br>Valves 27 and 28 closed<br>Conventional operation for the cylinder valves |
| Economic rating: | Seal 18 closed<br>Valve 26 closed<br>Valves 27 and 28 open<br>Coupling on the expansion cylinders of the intake valves between them and exhaust valves between them. |

In normal rating, manifold 25 being short-circuited by the closed valves 27 and 28 and the expansion duct E being in communication with exhaust to the atmosphere, operation and gas circulation follow the conventional method.

Figure 7B:
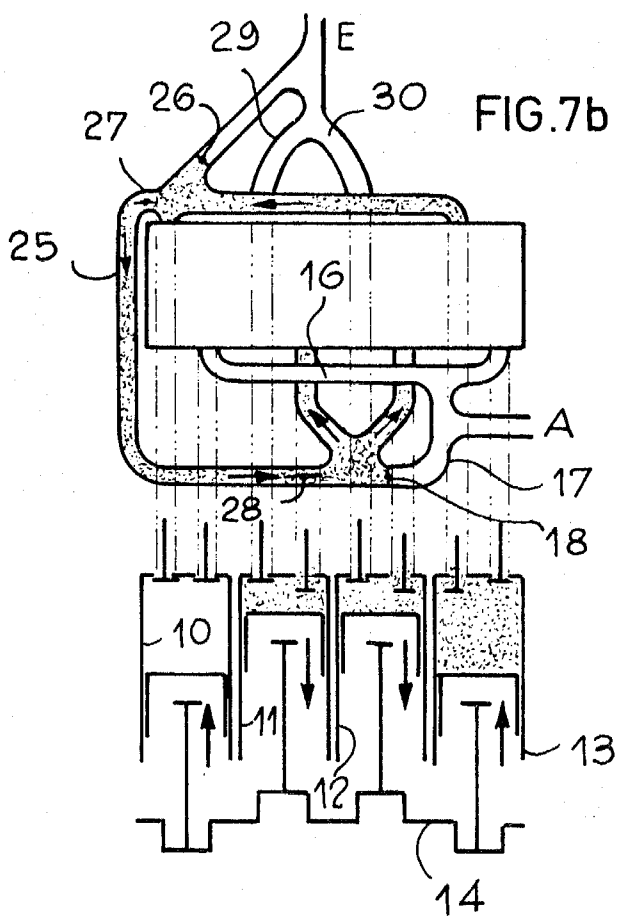
Figure 7A:
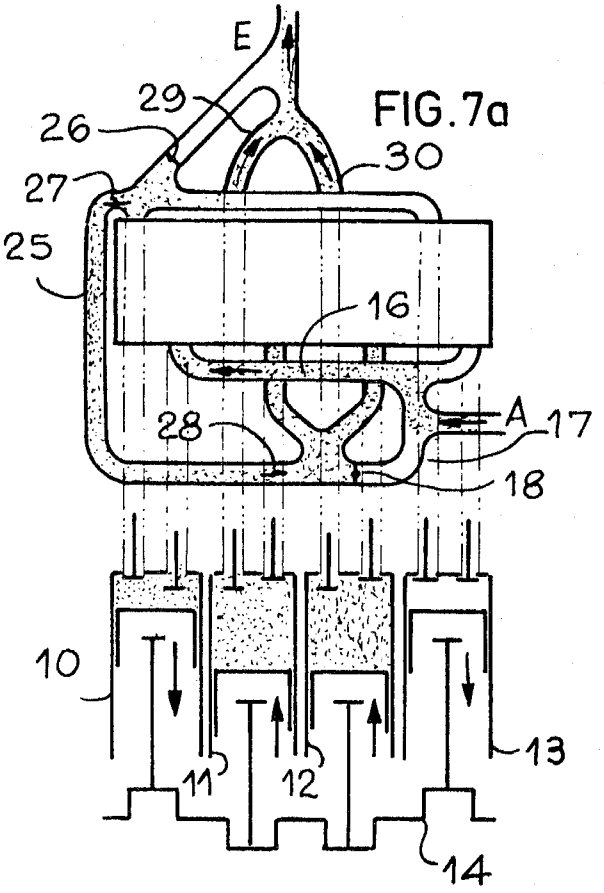

On economic rating, gas circulation during the four phases of the cycle takes place as follows:

FIG. 7*a:* The gases originating from combustion in cylinder 10, contained and expanded in cylinders 11 and 12, are delivered into the atmosphere by the open valves 11*e* and 12*e*, the ducts 29 and 30, and, at the end of the renewed upward movement of the pistons of the expansion cylinders, the exhaust valves 11*e* and 12*e* close, while inlet valves 11*a* and 12*a* open.

FIG. 7*b:* After explosion in the cylinder 13, the piston of the latter goes up again, the gases arrive in the expansion duct E and are transferred by the manifold 25 into the expansion cylinders the pistons of which travel downwards. At the end of the downward travel valves 11*a*, 12*a* close and valves 11*e*, 12*e* open.

Figure 7D:
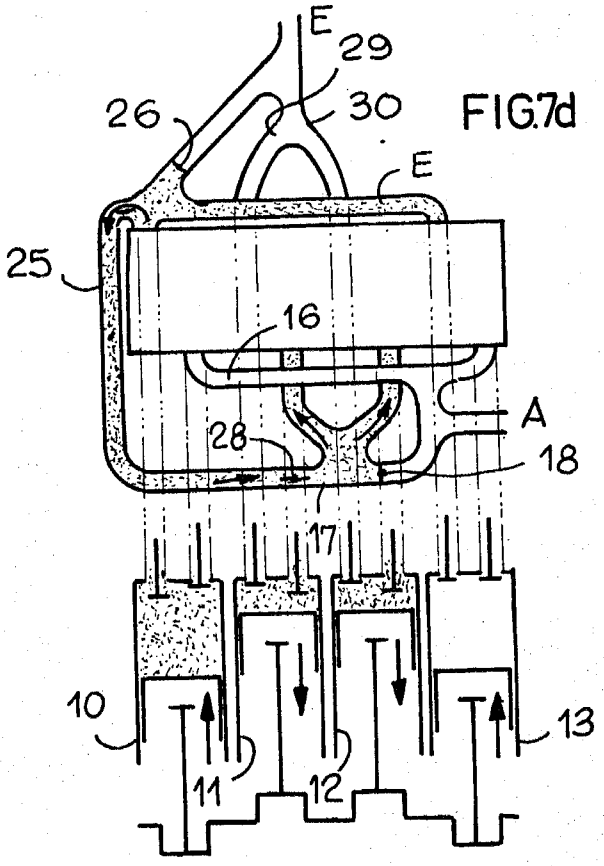
Figure 7C:
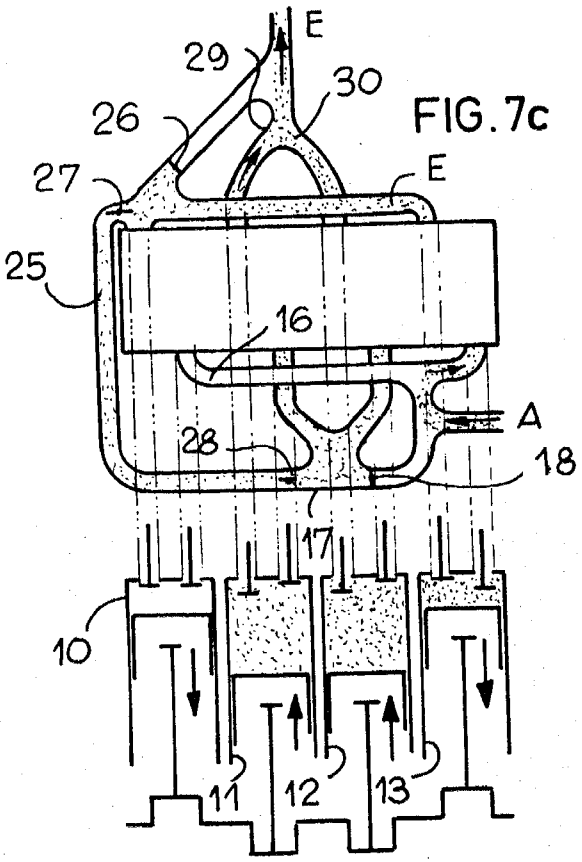

FIG. 7*c:* The gases expanded in the cylinders 11 and 12 are expelled into the atmosphere by the exhaust valves 11*e* 12*e* and ducts 29 and 30; at the end of the ascending movement of the expansion cylinders, there is a new inversion for the exhaust and intake valves of these cylinders.

FIG. 7*d:* After combustion in the cylinder 10, the piston of the latter travels up again and the gases are transferred by the manifold 25, the intake valves 11*a* and 12*a* in the expansion cylinders the pistons of which travel downwards, with the inversion of the valves at the end of the downward movement.

And the same cycle is repeated as long as the operation on economic rating continues.

In such an embodiment the coupling of the operation of the intake valves between them and of the exhaust valves between them in the expansion cylinders may be obtained by the direct action of a connection between said valves or by the action upon their distribution diagram.

In the foregoing the description has been restricted specially to describing the invention in the case of four-stroke engines, but it is obvious that it applies with the same bases to any four-stroke engine with any number of cylinders.

It will be observed that on economic rating the temperature and the pressure of the gases in the expansion duct E are higher than in the exhaust manifold of a conventional engine. These gases therefore exhibit greater reactivity, so that the exhaust duct may be advantageously used as an anti-pollution device, that is to say as an additional combustion chamber for the exhaust gases of the combustion cylinders. After elimination of the carbon monoxide, the gases pass into the expansion cylinders before they are expelled into the atmosphere.

I claim:

1. In a four-stroke internal combustion engine having a plurality of cylinders and passage means including valve means for conducting fuel to said cylinders and exhaust gases from said cylinders to the atmosphere:

at least one of said cylinders being operated by said valve means at all times in the conventional four-stroke sequence mode;

at least one other of said cylinders being alternatively operable by said valve means in one of two sequence modes, one of said sequence modes being the conventional four-stroke sequence;

said valve means, when said other cylinder is operated in the other sequence mode, directing exhaust gases from said one cylinder to the other cylinder prior to exhausting said gases to the atmosphere.

2. The invention defined in claim 1, wherein there are an even number of cylinders each containing a movable piston connected to a common crankshaft, the connections between the crankshaft and one half of the pistons being angularly displaced 180° with respect to the connections between the crankshaft and the other half of the pistons, each of the cylinders being provided with separate intake and exhaust valve means:

the valve means of the cylinders containing said one half of the pistons being operable only in the conventional four-stroke sequence;

the valve means of the cylinders containing the other half of the pistons being alternatively operable in one of two modes;

one of said modes being the conventional four-stroke sequence;

the other of said two modes being a sequence in which exhaust gases from each of said one half of the cylinders is directed to said other half of the cylinders prior to discharge to the atmosphere by constantly open exhaust valve means and constantly closed inlet valve means of said other half of the cylinders.

3. The invention defined in claim 1, wherein said valve means comprises separate intake and exhaust valve means for each of said cylinders always operable in the conventional four-stroke sequence, said valve means also including auxiliary valve means for said other cylinders, said auxiliary valve means being constantly closed during operation in said one sequence mode and being constantly open during operation in said other sequence mode.

4. The invention defined in claim 3, wherein said passage means includes auxiliary passage means communicating between said one cylinders and said other cylinders through said auxiliary valve means, and additional auxiliary valve means is provided for communication between said auxiliary passage means said other cylinders and the atmosphere.

5. The invention defined in claim 1, wherein said valve means comprises separate intake and exhaust valve means for each of said cylinders always operable in the conventional four-stroke sequence, said passage means including additional passage means and valve means communicating between said cylinders for admitting exhaust gases from said one cylinders into said other cylinders through their exhaust valve means when operated in said other sequence mode.

6. Method of operating a multiple cylinder four-stroke internal combustion engine in one mode under normal load and in another mode under a low load, comprising the steps of:

operating all of said cylinders in the conventional four-stroke mode when under normal loads, and;

when operating under low loads;

introducing the exhaust gases from at least one of said cylinders into another of said cylinders during the expansion stroke of said another cylinder, and;

releasing said introduced gases to the atmosphere from said another cylinder during the compression stroke of said another cylinder.

* * * * *